United States Patent [19]

Jervis, Jr.

[11] 4,159,571

[45] Jul. 3, 1979

[54] GEOMETRICAL INSTRUMENT

[76] Inventor: John H. Jervis, Jr., 48 Cliff Rd., West Milford, N.J. 07480

[21] Appl. No.: 865,842

[22] Filed: Dec. 30, 1977

[51] Int. Cl.[2] ..... B43L 13/14

[52] U.S. Cl. ..... 33/403; 33/432; 33/494

[58] Field of Search ..... 33/77, 107, 111, 1 F, 33/75 R, 192

[56] References Cited

U.S. PATENT DOCUMENTS 410,050 8/1889 Varley ..... 33/77

1,986,506 1/1935 Harris ..... 33/111

*Primary Examiner*—Harry N. Haroian

[57] ABSTRACT

A device having two scales, one for vertical height and one for vanishing point distance, that permits perspective drawings to be made without the need for the actual plotting of the vanishing points; and that permits vanishing points of any distance apart to be used in any size drawing. These two scales are mathematically related and are linear in graduation with said graduation being of any convenient size or nomenclature as long as the relationship between the two scales is maintained.

1 Claim, 6 Drawing Figures

GEOMETRICAL INSTRUMENT

BACKGROUND OF THE INVENTION

Whereas Perspective Drawing is the art of recreating three-dimensional objects on a single plane (flat) drawing, the use of vanishing points, for each surface plane of the object, is necessary to give the appearance of depth.

In viewing a scene, lines on plane surfaces appear to converge at a point on the horizon, which is the meeting line of the sky and ground. For objects of extreme height, or with multiple surfaces at oblique angles to one another, additional vanishing points exist, other than those on the horizon. In each case, every vanishing point must be plotted, once its existence is determined to be necessary.

In perspective drawing, there are direct relationships between drawing size and distance between vanishing points. Architects, engineers, draftsmen and others who use perspective drawing, usually desire the drawing to be as large as possible to exact maximum detail. Big office complexes and huge buildings and other large objects can require drawings up to 3 foot by 5 foot to include all the required architectural and engineering detail.

As the drawing gets larger, the vanishing points get farther away; sometimes requiring vanishing point distances of 5 to 10 feet away from the actual drawing paper. This represents a real problem to the person making the perspective drawing as he must stretch a string or ruler these distances to get accurate perspective lines. Also, he must have a large drawing surface on which to place these vanishing points.

Many inventions and methods have been disclosed to solve this problem. In each disclosure, the limitations are obvious and these limitations restrict the usefulness of the invention. For example, some inventions require the use of a complicated and cumbersome apparatus. Others only offer very limited vanishing point distances. Still others require estimating of perspective lines not included in the embodiment of the invention or method.

It is the object of this invention to provide a means to enable anyone to make a perspective drawing of any size suitable to the needs presented by the object being drawn.

Another object of the invention is to provide a means to restrict to the drawing paper any and all vanishing points, or vanishing point references.

Another object of this invention is to provide a means to enable anyone to construct a perspective drawing which conforms to all popular and recommended procedures, sizes, relationships and laws for perspective drawing, with as many vanishing points as are necessary and from any viewpoint desired, with the provision included that all perspective lines that must appear in the drawing can be constructed through the use of this invention.

SUMMARY OF THE INVENTION

With the above objects in view, a specific embodiment of the invention comprises two scales: the first being the height scale, the second being the distance scale; which, when scale 1 and scale 2 are used together, they will establish a method for constructing accurate perspective drawings.

DESCRIPTION OF THE SPECIFIC EMBODIMENT

Although the following disclosure offered for public dissemination is detailed to ensure adequacy and aid understanding, this is not intended to prejudice that purpose of a patent which is to cover each new inventive concept therein, no matter how others may later disguise it by variations in form or additions or further improvements. The claims at the end hereof are intended as the chief aid toward this purpose; as it is these that meet the requirement of pointing out the parts, improvements, or combinations in which the inventive concepts are found.

Figure 2A:
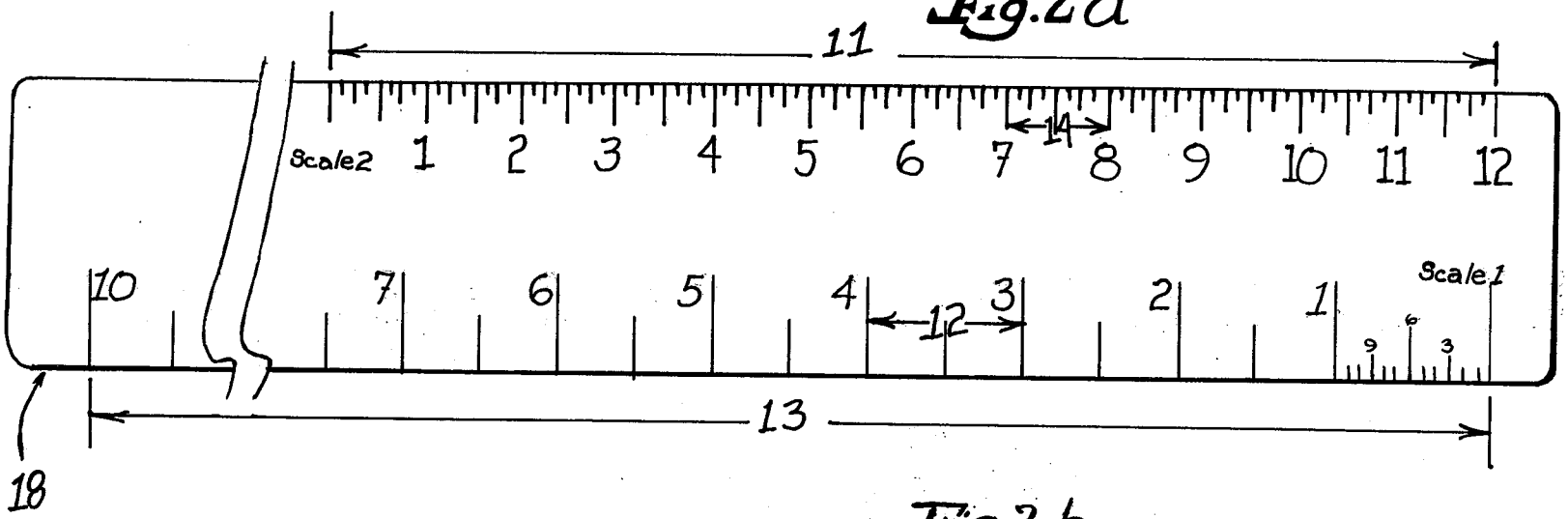
FIGS. 2*a* and 2*b* show the front and back side of an embodiment of the invention.
Figure 2B:
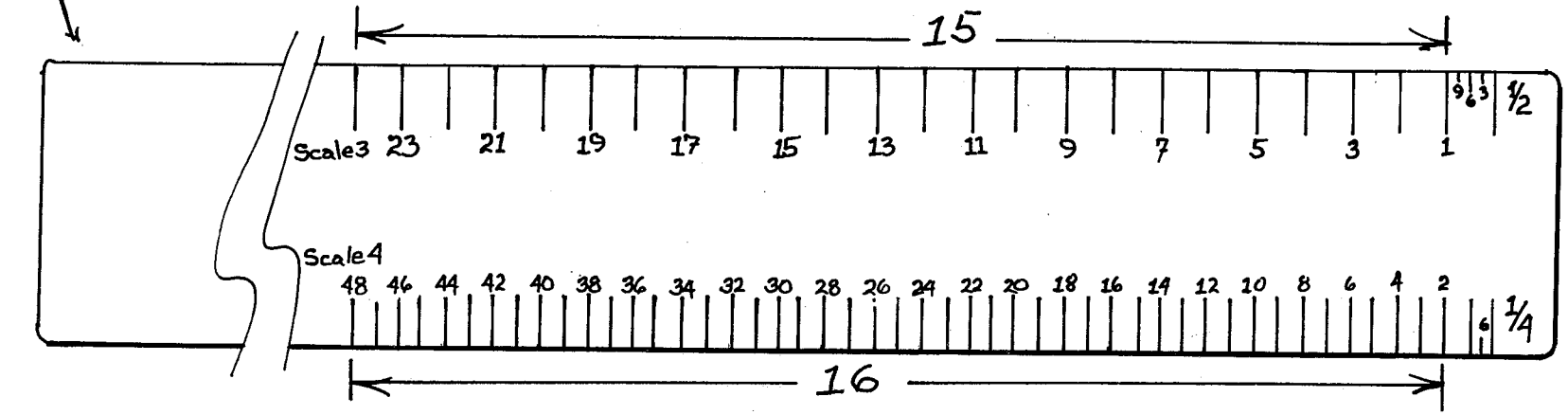

The illustrated embodiment, FIGS. 2*a* and 2*b* comprises a strip of solid material 18. This solid material contains, reproduced on one side, two primary scales 11 and 13 of equal subdivisions 14 and 12 respectively, said subdivisions 14 and 12 not necessarily equal to each other. The other side of the strip of material 18 contains two additional secondary scales 15 and 16, the total length of each equals primary scale 11, but whose equal subdivisions are different from the subdivision 14 of scale 11.

Figure 1:
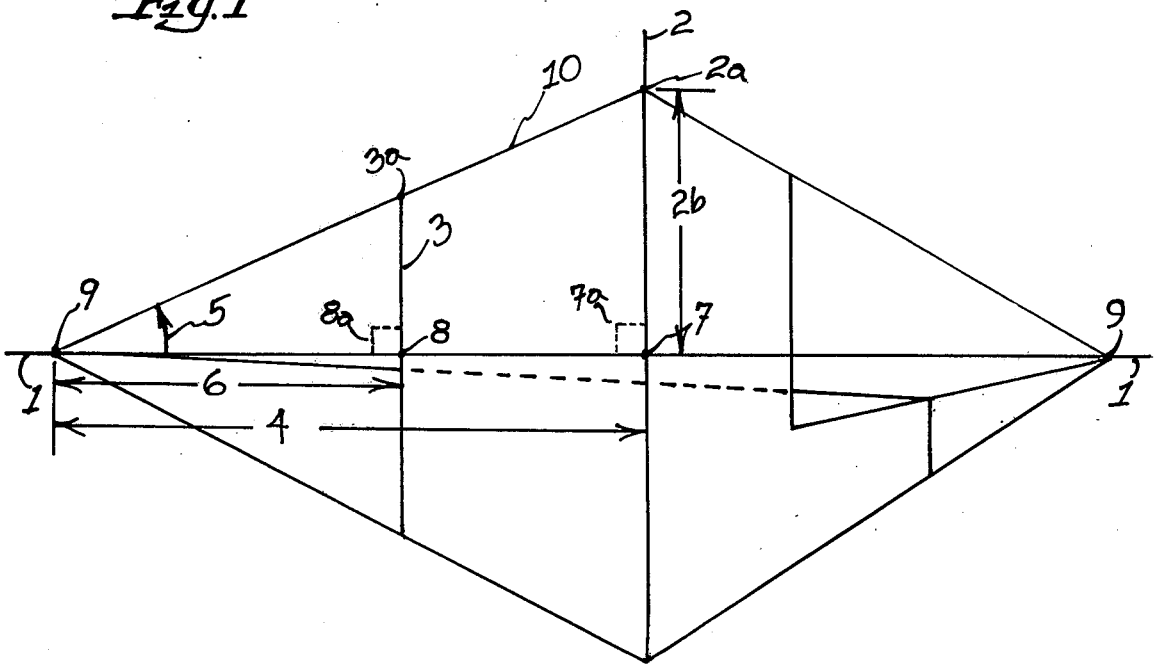
FIGS. 1, 1*a* and 1*b* are diagrams showing the trigonometrical relationship between lines in a typical part of perspective drawing.

FIG. 1 represents a typical part of a perspective drawing in which there is drawn a horizon line 1, centerline 2, vanishing points 9. Centerline 2 is perpendicular to horizon line 1 and creates a 90 degree angle 7*a* at a point 7 on the horizon line. The vanishing point 9 is a prescribed distance 4 from the intersection 7 of the horizon and center lines. A line 10 is drawn from a point 2*a* on the centerline to the vanishing point 9 and is now a perspective line which forms an angle 5 with the horizon line 1 at the vanishing point 9. Any line 3 drawn perpendicular to the horizon line 1 at a distance 6 from the vanishing point 9, where said distance 6 is less than the distance 4 between the centerline 2 and the vanishing point 9, will intersect the perspective line at a point 3*a*, will intersect the horizon line 1 at a point 8 and will form a 90 degree angle 8*a* with the horizon line 1 at that point 8.

Figure 1B:
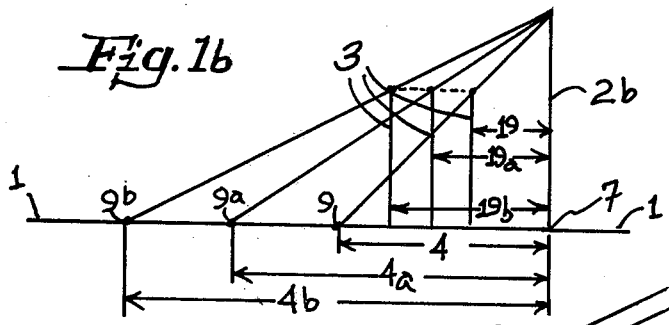
Figure 1A:
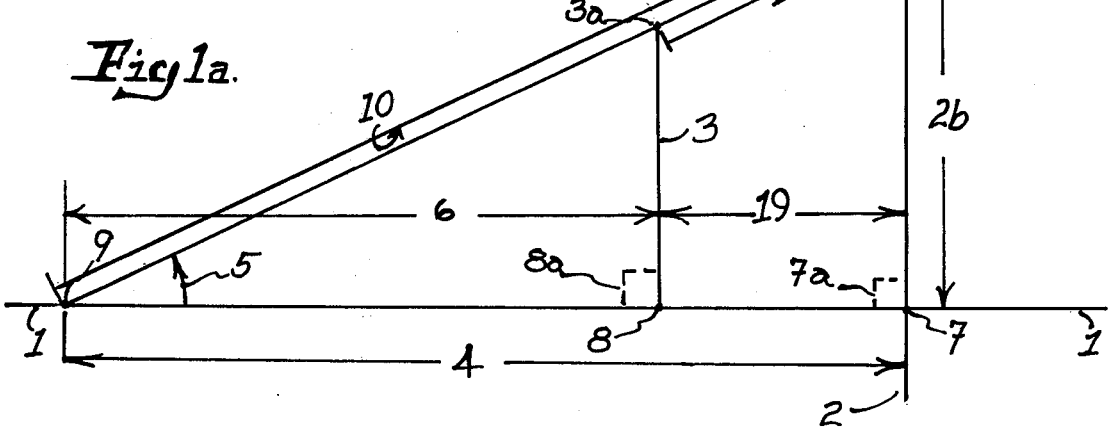

FIG. 1*a* represents a geometrical diagram using all the aforementioned elements and that will be used to show the development of the relationships on which the herein disclosed invention is based.

FIG. 1*a* is viewed as two separate triangles, each having three sides 10, 2*b* and 4; and 10 less 10*a*, 3 and 6 respectively, and a common acute angle 5. These two triangles are right triangles because of the 90 degree angles 7*a* and 8*a*, respectively.

The law of tangent in right triangles establishes the following relationship; tangent of the angle equals the side opposite divided by the side adjacent. In FIG. 1*a*, if the tangent angle chosen is the angle formed at the vanishing point 9 by the perspective line 10 and the horizon line 1, then the two triangles will form the equations tan angle 5 equals opposite side 2*b* divided by adjacent side 4; and tan angle 5 equals opposite side 3 divided by adjacent side 6. As two things equal to the same thing are equal to each other, then the length of side 2*b* divided by the length of side 4 equals the length of side 3 divided by the length of side 6.

In perspective drawings, the centerline is defined as the closest vertical line to the viewer of an area being drawn. This line is then used to scale the drawing in terms such as one inch equals a foot, one half inch equals a foot, etc.

The centerline 2 is therefore scaled off, using a standard architect's scale between a point 2*a* on the centerline and the point of intersection 7 of the centerline and the horizon line which forms line 2*b* of a finite length.

If line 6 is given a finite value and line 3 is given a finite value, it is shown in FIG. 1*b* how changing the distance 19 between line 2*b* and line 3 will cause a subsequent change in the distance 4 between the vanishing point 9 and the center line 2, keeping line 3 and line 2*b* constant in length. Referring to the original equation where side 2*b* divided by side 4 equals side 3 divided by side 6, the equation can be modified to establish an equation where side 2*b* divided by side 3 equals side 4 divided by side 6.

Having established that varying the distance 19 between line 2*b* and line 3 creates a corresponding variable in the length of line 4, the equation is modified to include distance 19 as follows:

Since the length of line 6 equals the length of line 4 less the length of line 19, the equation is refined as follows: the length of line 2*b* divided by the length of line 3 equals the length of line 4 divided by the difference between the length of line 4 and the length of line 19.

Having already defined the length of line 2*b* as finite (scaled to a definite length using an architect's scale) and the length of line 3 being made finite, the first basic relationship on which the invention is based becomes evident; as the distance between constant length line 2*b* and constant length line 3 varies, the distance between the vanishing point 9 and the centerline 2 varies accordingly and predictably.

Interpolating further, if the change in length of line 4 is defined as equal to the finite length of line 2*b*, then the change in length of line 4 less the change in length of line 19 will equal the constant length 3.

Also, with the aforementioned relationships being true, the final relationship is established where the constant length of line 3 plus the unit of measure for the change in length of line 19 will equal the constant length of line 2*b* if the change in line 4 is equal in the unit of measure to the unit of measure of line 2*b*. If 2*b* is defined as a foot, then line 3 plus the unit of measure of line 19 will equal 1 foot, and, if line 3 is 11 inches, then the unit of measure of line 19 will be 1 inch where a 1 inch change in the length of line 19 will effect a 1 foot change in the length of line 4. Also, if fractional parts of the unit of measure of line 19 are used to change its length, then the change in the length of line 4 will be in the same fractional proportion.

In the specific embodiment of the herein disclosed invention, the two primary scales 11 and 13 in FIG. 2 can now be defined:

Primary scale 11 corresponds to the constant length of line 3 in FIG. 1. Primary scale 13 has equal subdivisions 12 where each subdivision 12 corresponds to the change in length of line 19 in FIG. 1.

The invention being disclosed can be defined as follows: If the centerline of a drawing is scaled off to a finite length above the horizon line, and a second line perpendicular to the horizon line is scaled off to a finite length of the centerline, the placing the two lines apart at a distance equal to their difference, a line connecting the tops of the two vertical lines will meet the horizon line at a point that is a distance removed from the centerline equal to the finite length of the centerline.

Each subsequent change in the distance between the vertical lines will cause a predictable change in the distance between the centerline and the point where the connecting line intersects the horizon line. Where the change in distance between the vertical lines is a multiple or fraction of the difference in heights, the change in distance between the intersecting point and the centerline will be an identical multiple or fraction of the finite length of the centerline.

If two parallel lines intersect common radians from a point, each of the parallel lines will be divided proportionately.

Because of this axiom, if two vertical lines, perpendicular to the horizon line, are subdivided similarly, the connecting the similar subdivisions will result in radians converging at a common point. In the case of this disclosure, that common point will be the vanishing point.

Figure 3:
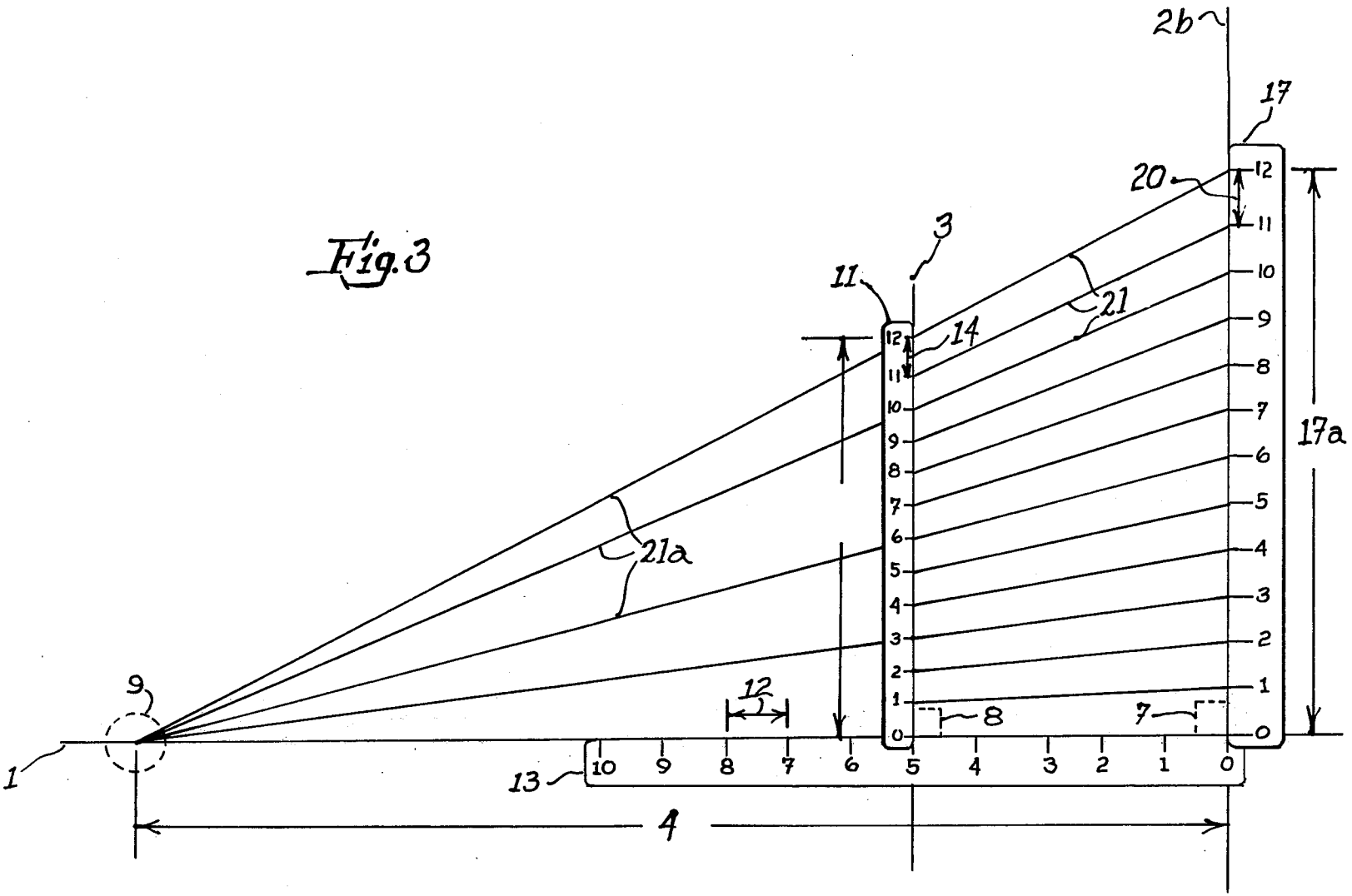
FIG. 3 is a diagram showing how a perspective drawing may be made with the invention.

Relating to FIG. 3, a typical perspective drawing can be made with the invention as follows;

1 Establish and draw horizon line 1.
2 Establish and draw centerline 2 above and below the horizon line.
3 Determine scale and finite height of scale 2*b* and mark off line 2*b* above and below the horizon line accordingly, using a standard ruler.
4 Determine vanishing point distances desired using standard accepted perspective drawing methods.
5 Using primary scale 13, mark off the number of units 12 corresponding to the number of units (for example feet) of vanishing point distance and put a mark 8.
6 Construct a line 3 perpendicular to the horizon line 1 at that point 8.
7 Using primary scale 11, mark off line 3 in units 14 corresponding to the number of units marked off on line 2*b*.
8 Establish the height of the object to be drawn on scaled line 2*b* and connect similar points on the lines 2*b* and 3. These connecting lines 21 would all converge at point 9, i.e., the vanishing point, if extended that far.
9 The same above procedures will apply to all vanishing points above or below the horizon line and to the right or left of the centerline. However, the centerline 2 has only to be scaled off once to its finite length 2*b* for any and all vanishing points to the right and/or left. If vanishing points are to be used above or below the horizon, scale the centerline as if it were the horizon and scale the horizon line as if it were the centerline, following the procedures above.
10 For other points, not commencing on the centerline, lining the point up with two similar points on lines 2*b* and 3 will result in a line 21 that also will converge at the vanishing point 9, if extended.

Obviously, the invention can be carried out in many different ways, of which the embodiment shown and described, is merely illustrative. Therefore, I do not desire to be limited by that embodiment, but only by the following claims.

I claim:

1. A measuring device used to construct an accurate perspective drawing with as many vanishing points and from any viewpoint deemed necessary, without the actual use of vanishing points, said device having two scales thereon adjacent marginal edge portions thereof, the first being a height scale marked off in the same number of units similar to, but proportionately smaller than, a standard ruler or architect's scale used to graduate a centerline arranged perpendicular to a horizon line, said height scale having a total length which is a pre-determined length shorter than the total length of the standard ruler, and the second being a distance scale marked off in units equal to the difference in length between the height scale and the total length of the standard ruler or architect's scale, whereby the height scale is used to calibrate a vertical line parallel to the centerline with the vertical line placed to the side of the centerline a distance determined by the distance scale and where lines drawn between similar points on the centerline and vertical line will intersect the horizon line at a point whose distance from the centerline is equal to the space between the vertical line and the centerline in distance scale units times the total length of the scale or ruler used to graduate the centerline.

* * * * *